US007677364B2

(12) United States Patent
Begle

(10) Patent No.: US 7,677,364 B2
(45) Date of Patent: Mar. 16, 2010

(54) ELEVATOR INSTALLATION COMPRISING A LIGHT MODULE IN THE DOOR SILL PROFILE

(75) Inventor: Guntram Begle, Küssnacht a/Rigi (CH)

(73) Assignee: Inventio AG, Hergiswil (CH)

( * ) Notice: Subject to any disclaimer, the term of this patent is extended or adjusted under 35 U.S.C. 154(b) by 456 days.

(21) Appl. No.: 11/666,217

(22) PCT Filed: Oct. 18, 2005

(86) PCT No.: PCT/CH2005/000606

§ 371 (c)(1),
(2), (4) Date: Jun. 19, 2007

(87) PCT Pub. No.: WO2006/045211

PCT Pub. Date: May 4, 2006

(65) Prior Publication Data

US 2009/0120730 A1 May 14, 2009

(30) Foreign Application Priority Data

Oct. 25, 2004 (EP) ..... 04105282

(51) Int. Cl.
*B66B 1/34* (2006.01)

(52) U.S. Cl. ..... 187/391; 187/325; 187/334

(58) Field of Classification Search ..... 187/313, 187/325, 333, 334, 391, 393, 400, 413, 414
See application file for complete search history.

(56) References Cited

U.S. PATENT DOCUMENTS 5,609,224 A * 3/1997 Baggot ..... 187/313

FOREIGN PATENT DOCUMENTS

| | | | |
|---|---|---|---|
| JP | 04235886 | | 8/1992 |
| JP | 10305981 | A * | 11/1998 |
| WO | WO 2004/022470 | | 3/2004 |
| WO | WO 2008105871 | A1 * | 9/2008 |

* cited by examiner

*Primary Examiner*—Jonathan Salata
(74) *Attorney, Agent, or Firm*—Wolff & Samson, PC

(57) ABSTRACT

An elevator installation contains an elevator car (12) that is arranged movably between floors (S1, S2) in an elevator hoistway (11). The elevator car (12) has a car door (14), and the elevator hoistway (11) has on the each floor (S1, S2) a hoistway door (13). Assigned to the car door (14), or to the hoistway door (13), is a sill-section (16). To draw attention to a gap (30), or give a warning of a step, between elevator car (12) and floor (S1, S2), it is proposed to arrange in the sill-section (16) of the elevator car (12), or of the floor (S1, S2), at least one light module (20, 21, 22).

14 Claims, 4 Drawing Sheets

ELEVATOR INSTALLATION COMPRISING A LIGHT MODULE IN THE DOOR SILL PROFILE

This is a U.S. national stage of application No. PCT/CH2005/000606, filed on 18 Oct. 2005. Priority is claimed on that application and on the following application:

Country: European, Application No.: 04105282.0, Filed: 25 Oct. 2004

BACKGROUND OF THE INVENTION

The invention relates to an elevator installation with an elevator car that is arranged movably in an elevator hoistway between floors, the elevator car having a car door, and/or the elevator hoistway having on the floors a hoistway door. Assigned to the car door or hoistway door is a sill-section. The invention also relates to a method of indicating a gap between an elevator car and a floor in an elevator installation, the elevator car being moved in an elevator hoistway between floors.

Modern elevators have a hoistway door and a car door. The hoistway door closes the elevator hoistway on the respective floors when no elevator car is present on this floor. The hoistway door is opened when the elevator car stops at a floor for passengers to enter and leave. The elevator car is closed by an elevator door. While the elevator car is moving in the elevator hoistway, this elevator door is closed. For entering and leaving on a floor, the elevator door is opened. The hoistway door or car door is often executed with two parts, and consists essentially of two door panels, of which a first door panel is guided to approximately the middle of a door opening, and a second door panel closes the remaining open half of a door opening. Irrespective of the execution, the hoistway door, or car door, is guided at least in a floor area of the floor, or of the elevator car, in a sill-section. The sill-section is usually made of aluminum. Despite high accuracy of manufacture, when the elevator car stops, a gap remains between the elevator car and the respective floor. With regard to injury of persons, this gap is mostly not dangerous. It is, however, possible for objects to fall into this gap. Furthermore, should there be a fault in the functioning of the elevator installation, it is possible for there to be a difference in level between the height of the floor and the height of the elevator car which can form a dangerous ledge, or step, that can cause injuries to persons entering or leaving.

From JP 04235886 an elevator installation is known that has a sill-section in the floor and a sill-section in the elevator car floor. Arranged on the elevator car door is an outward-projecting plastic cap. Installed below the plastic cap is a light source that, through a slit of the plastic cap, emits light that is visible to entering and leaving passengers.

In present-day elevator installations, such an arrangement is no longer possible, since the gap between the level of the floor and the elevator car does not allow the installation of additional elements. Typically, the gap is 1 cm wide. The available space is therefore greatly restricted and the sill-section of the elevator car is correspondingly narrowly constructed. Furthermore, the slit in the plastic cap through which the light emerges can become soiled—since elevator users tread on this plastic cap—which causes the warning of occurrence of a difference in level to be no longer perceptible, and thus useless, so that a safety risk arises.

SUMMARY OF THE INVENTION

Against this background, the objective is to propose an elevator installation and a method in which attention is drawn to a gap, or step, between floor and elevator car, and in which the warning function is not impaired by soiling without additional elements and/or space being necessary.

The invention is based on the idea that in an elevator installation with an elevator car that is arranged movably in an elevator hoistway between floors, the elevator car having a car door, or the elevator hoistway having on the floors a hoistway door, for the purpose of warning of a gap or a step between car and floor of the elevator installation at least one light module is arranged in a position in which the warning is readily visible. By integration of the light module in a sill-section of the floor and/or of the elevator car, the light is emitted as warning and is certain to be perceived by users of the elevator. Advantageously, the warning light is emitted at exactly that point at which the danger from a gap, or step, occurs. Advantageously, the light module in the sill-section is subjected to a cleaning effect by the constant movement of the door, so that soiling of the light module is constantly removed and thus the warning of a gap, or of a step, is also certain to be perceived.

The light module is advantageously arranged in the floor area of the elevator car and/or of the floor. Since persons entering or leaving an elevator usually look at the floor, a light module that is arranged in the sill-section of the car door or hoistway door is especially readily visible.

Advantageously, the sill-section has a groove. The light module is directly mounted in this groove, without additional mechanical elements for fastening and/or protection being necessary. Advantageously, the car door and/or the hoistway door respectively are guided in the corresponding sill-section in a door guide-groove. Such a door guide-groove is necessary on the upper side of the sill-section to guide the elevator door. The door guide-groove is the area of the sill-section that lies immediately adjacent to the door, and that guides at least one door panel. According to the invention, the light module is integrated and built into the upper side of the sill-section in space-saving manner. 'Space-saving' means that the width of a sill-section is not affected by the presence of the light module. The minimum width of the sill-section, which is largely determined by the width of at least one door panel and space for fastening means, remains unchanged narrow. This integration of the light module into the door guide-groove has the advantage that the rigidity of the sill-section is not impaired by an additional groove. Furthermore, there is no need for additional grooves adjacent to the door guide-groove to pick up and collect possible soiling matter without it being possible for this to be regularly pushed back into the door guide-groove. Additional elements and/or space for integrating the light module into the sill-section are therefore not needed. In addition, installation and maintenance of the light module are made simpler and faster, since the light module is integrated directly into the sill-section in space-saving manner without additional mechanical elements.

In a preferred embodiment, the light module extends into a side area of the elevator car and/or of the floor. The light module is also at least partially visible in the side areas of the elevator car or of the floor. The sill-section can then extend into the respective side area, the light module being in this case integrated in this side sill-section. The light module can be arranged exclusively in the side area of the elevator car or of the floor. However, it is also possible to arrange the light module in both the floor area and the side area. Further, it is possible to arrange the light module in the side area of the elevator car, or of the floor, without a sill-section.

To allow fault-free functioning of the light module, it is advantageously foreseen for the light module to be arranged in at least one vertical wall of the door guide-groove. This arrangement of the light module prevents dirt in the door guide-groove from covering the light module. In addition, the backwards and forwards movement of the doors in the door guide-groove removes a possible deposit of dirt from in front of the light module.

In the case of a telescopic elevator door with multiple door panels, to save as much space as possible the light module is advantageously arranged between the two door guide-grooves for the door panels of the door.

A further preferred embodiment of the invention foresees arranging in the door guide-groove a first light module which is directed into a car interior space and can therefore be perceived from the direction of the car interior space. Also arranged in the same door guide-groove on the opposite vertical wall is a second light module that is directed in the opposite direction so as to shine out of the car interior and be perceptible when entering the car. The arrangement of the two light modules in the door guide-groove has the advantage that a light emitted by the light module can be perceived both when entering the elevator car and when leaving the elevator car. Mounting in a respective vertical wall rules out soiling and thus also impairment of visibility.

An advantageous embodiment of the invention foresees forming the sill-section with an inner and an outer door guide-groove. This embodiment is especially used when the car door, and/or the hoistway door, is formed of two parts. It is then advantageous for the first light module to be arranged in the outer, and the second light module in the inner, door guide-groove. The first light module is thus visible from the car interior and can be perceived when leaving the elevator car. The second light module is visible when entering the elevator car. Mounting the first and second light modules in the inner and outer door guide-grooves has the advantage that rigidity of the sill-section is maintained, and influence of the localized gap on the light emitted from the light modules is reduced, so that the two light modules can be separately controlled and thereby selectively switched on and off depending on the state of the elevator installation. For example, with the elevator car empty, it is not necessary for the light module directed into the car interior to be switched on, since no persons are present in the car interior.

Alternatively, it is possible for the first light module and the second light module to be arranged in adjacent walls of a sill-section. This makes a common voltage supply to the two light modules possible with consequent reduction of the installation outlay and costs.

A further preferred embodiment of the invention foresees the light module being so controlled that it emits a light signal depending on a position of the elevator car. By this means attention can, for example, be drawn to a dangerous situation from a difference in level between the floor and the elevator car. It is also possible to divide the light module into sections and to switch the sections on and off alternately. The light module can extend over the entire length in the floor area and/or in the side area of the elevator car and/or of the floor. It can, however, also be arranged on one or several positions in the floor area or in the side area of the elevator car and/or of the floor.

Advantageously, the light module emits a light signal in the white range of wavelengths. White light is especially readily visible. It is also advantageous for the light signal emitted by the light module to be emitted depending on a car door position and/or a hoistway door position. It is, for example, not necessary to activate the light module when the doors are closed, since a light module integrated in the sill-section is then no longer visible. A further possibility is for the light module to be always permanently switched on when the respective doors are opened, without regard to the elevator position. This has the advantage that the user of the elevator is always made aware of the gap between the elevator car and floor, irrespective of whether or not there is a difference of level between floor and elevator car.

It is especially advantageous for the light module to be formed of LEDs that are arranged, for example, on a printed circuit board. These LEDs are preferably covered with a diffusing disk that is preferably made from a scratch-resistant material. By this means it is possible to make the light module very compact and self-contained so that it can be inserted into even very small grooves of sill-sections, for example smaller than 1.5 cm. Through the diffusing disk, the light emitted by the LEDs is distributed uniformly so that the light module acts as a band of light. The use of LEDs ensures a low current consumption. Through use of the scratch-resistant material of the diffusing disk, the light module is protected against soiling and damage. The life of LEDs is also much longer than that of other, conventional, light sources.

It is also possible to integrate into the light module organic light-emitting substances that begin to glow when fed with current. Such OLEDs require no background illumination and are constructed flexibly. They also consume only very little energy, the emitted light being readily visible from every angle. OLEDs of large area can also be realized so that a light module according to the invention can have OLEDs mounted along its entire length. Other plastics, so-called smart plastics, that emit light can also be used.

A further means of causing the light module to glow is to integrate into the light module an optical waveguide. Coupled into an end-face of the optical waveguide by means of a good light source as, for example, a laser or LED, is a light. The optical waveguide is, in principle, intended to conduct light along its longitudinal axis, but when light is coupled into its end-face, light is also visible on the long side even of unmodified optical waveguides that are not sheathed. Furthermore, it is possible to modify a long side of the optical waveguide in such manner that light can emerge from the long side of the optical waveguide. For this purpose, the refractive index on the respective long side of the optical waveguide must be so altered that total reflection of the guided light waves does not occur there, but that the light waves can emerge from the optical waveguide at these points. Small irregularities in the surface of the inner optical waveguide change the refractive index so that the light can emerge at these points. The use of optical waveguides is advantageous because the coupling of light into the optical waveguide can be foreseen at positions in the elevator car, or on the floor, at which sufficient space is available and the supply of electric current is also unproblematical.

In an exemplary embodiment of the invention, there is arranged on the car door and/or the hoistway door a cleaning element in the area of the light module which, when the car door and/or hoistway door is opened or closed, is moved over the light module in such manner as to clean it. This cleaning element can take the form of, for example, a rubber lip or a brush. Through its movement over the light module when opening or closing, deposits of dirt on the light module are reliably removed.

It is especially advantageous for the light module to change its light color depending on a state of the elevator installation. For this purpose it is necessary to integrate into the light module light-emitting diodes, or substances, that can emit light of different colors, or to arrange several light-emitting diodes or substances that respectively emit different colors. A further means of increasing the warning effect of the light module is to change an illumination duration of the light module depending on a danger situation or warning situation.

Thus it is possible, for example, that on occurrence of a difference in level between floor and elevator car, the light module has imposed on it a timed pulse so that a pulsating light is emitted, its perceptibility being thereby increased. By contrast, to draw attention to a gap, a permanently active light is used. The permanently active light indicates to the passenger that there is no danger from a step. To alter the level of the warning function, it can be foreseen that when there is great danger as, for example, from a particularly high step between the level of the floor and the level of the elevator car, the light module is caused to flash at short intervals. When there is less danger, the interval between switching on and switching off can be lengthened.

In a method according to the invention for indicating a gap between an elevator car and a floor in an elevator installation, it is foreseen that the car door or hoistway door has assigned to it a sill-section. Arranged in a groove in the sill-section of the floor, and/or of the elevator car, is at least one light module that emits a light in the visible range of wavelengths.

BRIEF DESCRIPTION OF THE DRAWINGS

The invention is explained in more detail below by reference to exemplary embodiments which are illustrated diagrammatically in the drawings. Shown are in FIG. 1 a diagrammatic illustration of an elevator installation.

DETAILED DESCRIPTION OF THE INVENTION

Figure 1:
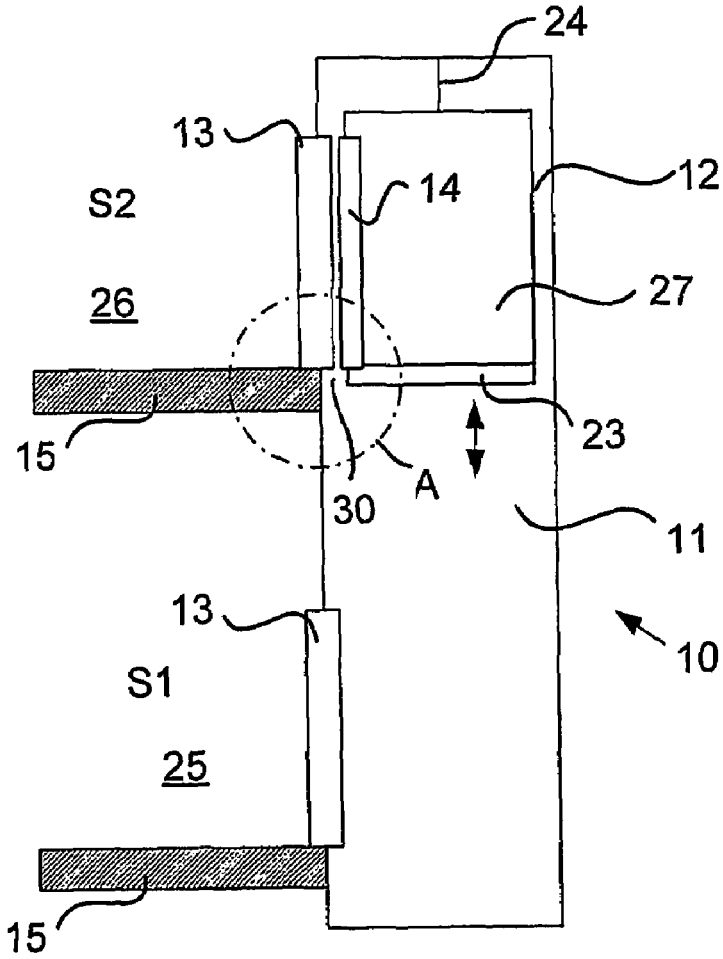

A structure of an elevator installation 10 is shown diagrammatically in FIG. 1. The elevator installation 10 contains an elevator car 12 that is caused to move in an elevator hoistway 11 between floors S1 and S2. The elevator car 12 is fastened to an elevator rope 24 to which motion is imparted by a motor (not shown). The elevator car 12 is closed by car doors 14. On the floors S1 and S2, the elevator hoistway 11 is closed by hoistway doors 13. In front of the hoistway doors 13 on the floors S1 and S2 are elevator landings 25, 26. A floor area of a floor S1, S2 is indicated by reference number 15. A floor area of the elevator car 12 is indicated by reference number 23.

Used in the exemplary embodiment described here are car doors 14 and hoistway doors 13 consisting in each case of two door panels (FIG. 6), a first door panel 13*a*, 14*a* covering a first door area, and a second door panel 13*b*, 14*b* covering a second door area, of the elevator car 12 or of the floor S1, S2. The hoistway door 13 is also formed of two parts. The door panels 14*a*, 14*b*, 13*a*, 13*b* of the car door 14 and of the hoistway door 13 are each guided in a sill-section 16. The sill-section 16 is arranged in the floor area 15 of the respective floor S1 or S2. The sill-section 16 in the elevator car 12 is arranged in the floor area 23 of the elevator car 12. The sill-sections 16 for the hoistway door 13 and for the car door 14 are essentially identically executed.

The sill-section 16 of the hoistway door 13 has an outer door guide-groove 17 and an inner door guide-groove 18. When viewed from an elevator landing 25, 26, the outer door guide-groove 17 is arranged furthest towards the elevator car 12, and the inner door guide-groove lies further into the elevator landing 25, 26. The door guide-grooves are, for example, 1.4 cm wide.

The inner door guide-groove 18 in the sill-section 16 of the elevator car 12 is set further into the car interior 27 than the outer door guide-groove 17 of the sill-section 16 of the elevator car 12.

Figure 2:
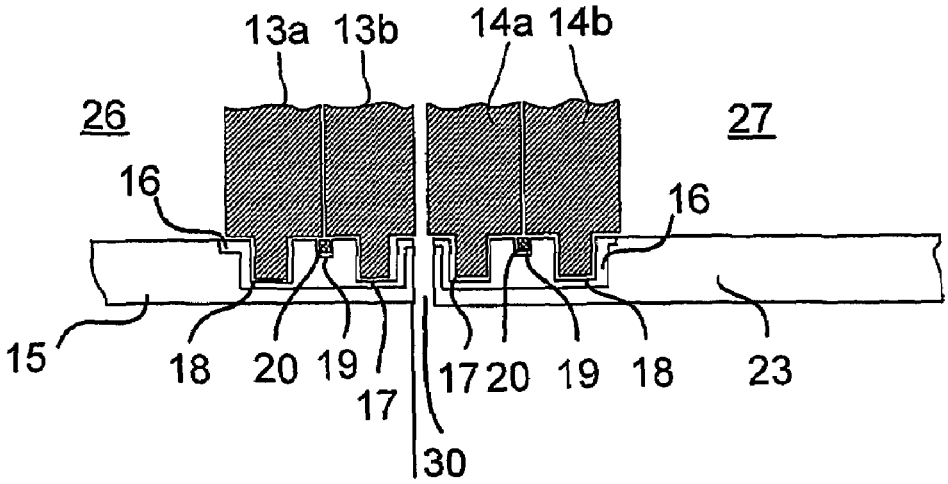
FIG. 2 an enlarged cross-sectional illustration of the detail A of FIG. 1.

The sill-section 16 has a groove 19 that is arranged adjacent to the inner and outer door guide-grooves 17, 18. This groove 19 is preferably dimensioned smaller than the door guide-grooves 17, 18. According to the invention, it is foreseen that in the groove 19 that runs between the door guide-grooves 17 and 18 a light module 20 is integrated. Clearly apparent from FIG. 2 is that the door panels 14*a*, 14*b* of the car door 14, and the door panels 13*a*, 13*b* of the hoistway door 13, are moved over the respective light module 20 in the sill-section 16 of the elevator car 12, and of the floor S2, and thus exert a cleaning effect on the light module 20. The space between the door panels 13*b* and 14*a* is very restricted and does not permit any mechanical elements to be built in between the two door panels.

Figure 3:
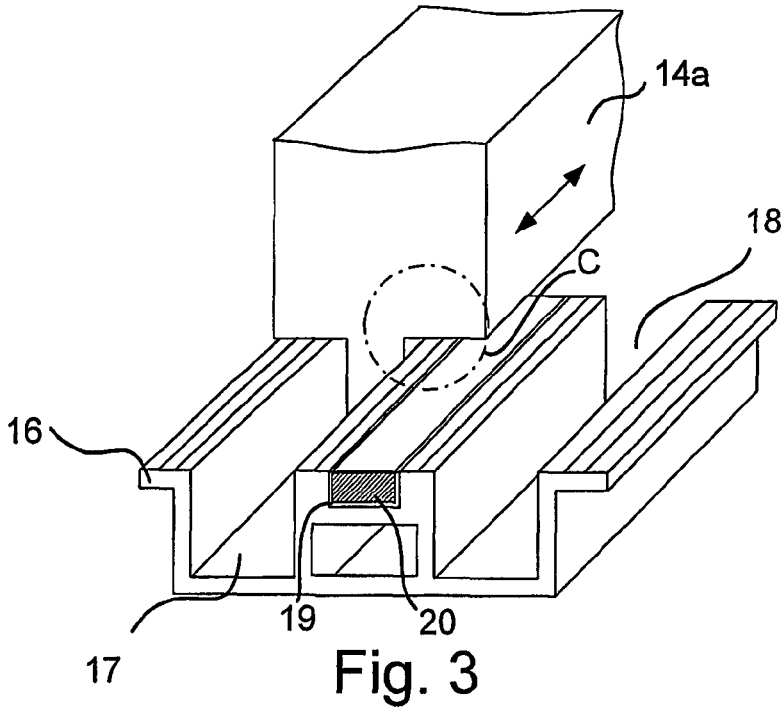
FIG. 3 a diagrammatic illustration of a sill-section according to the present invention.

An enlarged illustration of a sill-section 16 is shown in FIG. 3, specifically for a two-panel car door 14. The outer door guide-groove 17 is arranged at the outermost edge of the elevator car 12. Arranged between the outer door guide-groove 17 and the inner door guide-groove 18 is the groove 19 in which the light module 20 is accommodated. The movement of a diagrammatically sketched door panel 14*a* of the car door 14 in the outer door guide-groove 17 is indicated in FIG. 3 by the arrows.

Figure 4:
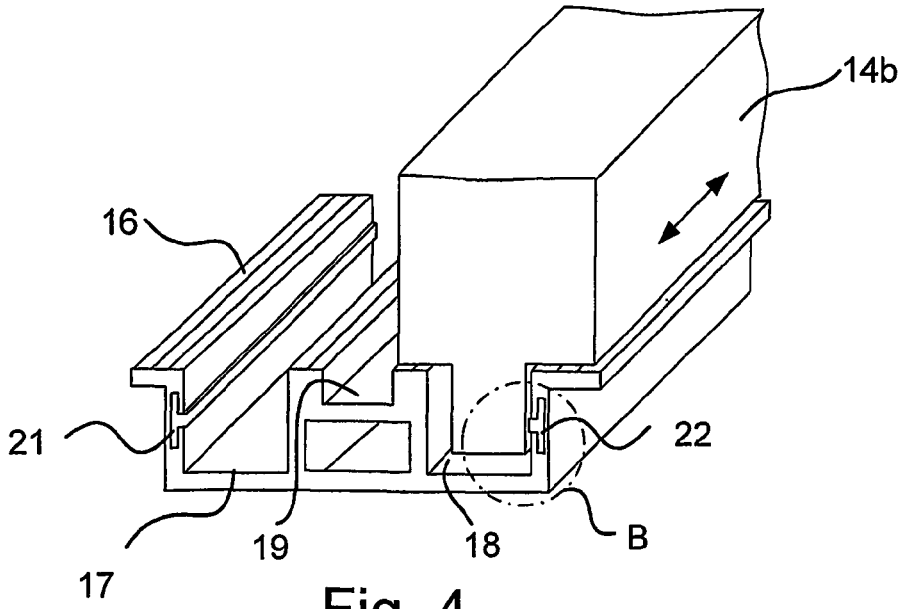
FIG. 4 an alternative embodiment of a sill-section according to the present invention.

In an alternative embodiment according to FIG. 4, a light module 21, 22 is arranged in a vertical wall of the door guide-groove 17, 18. Also shown is the sill-section 16 that is used in an elevator car 12. Integrated in the outer door guide-groove 17 is a first light module 21 that is arranged on the wall that faces into the car interior 27. Arranged on the vertical wall in the inner door guide-groove 18 is a second light module 22 which is visible when entering the elevator car 12. In this embodiment, the groove 19 that is arranged between the inner and outer door guide-grooves 17, 18 is open, so that possible deposits of dirt in the groove 19 can be picked up without being caught on the edges between the door panels 14*a*, 14*b* of the car door 14 and the sill-section 16.

Figure 5A:
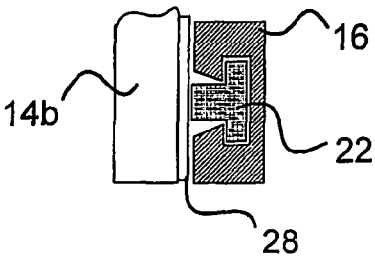
FIG. 5*a* an enlarged diagrammatic illustration of the detail B of FIG. 4.
Figure 5B:
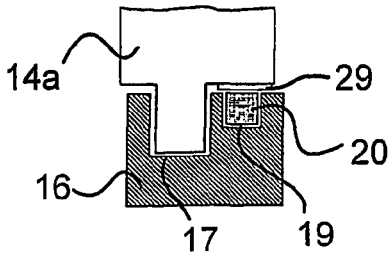
FIG. 5*b* an enlarged illustration of the detail C of FIG. 3.

The embodiment according to the invention of a sill-section 16 with a light module 20, 21, 22 is shown enlarged in FIGS. 5*a* and 5*b*, FIG. 5*a* showing enlarged the detail B of FIG. 4, and FIG. 5*b* showing enlarged the detail C of FIG. 3.

The light module 22 shown in FIG. 5*a* is accommodated with positive fit in the sill-section 16 and arranged in a vertical wall. The door panel 14*b* of the car door 14 is fitted with a cleaning element 28 which, on movement of the car door 14, is moved over the light module 22 and thereby exerts a cleaning effect.

In FIG. 5*b*, arranged on the door panel 14*a* of the car door 14 is a cleaning element 29 which, on movement of the car door 14, travels over the groove 19 and the light module 20 integrated therein and thereby cleans the light module 20.

Figure 6:
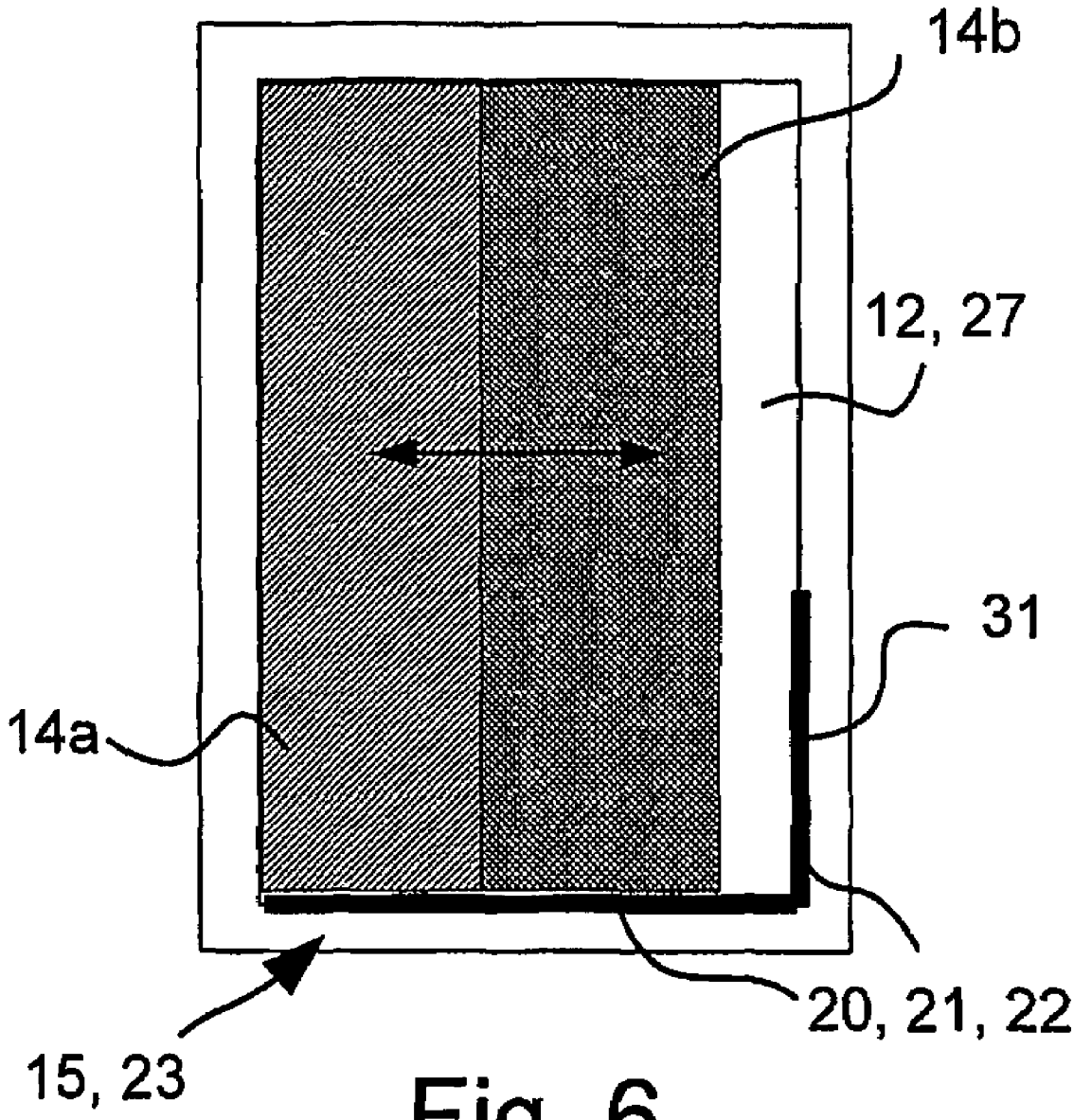
FIG. 6 a diagrammatic illustration of an arrangement of the light module in the elevator car or on the floor.

As an alternative to arrangement of the light module 20, 21, 22 in the sill-section 16 in the floor area 23, 15 of the car door 14, or of the hoistway door 13 respectively, it is also possible to arrange the light module 20, 21, 22 in a side area 31 of the elevator car 12 or of the floor S1, S2. This arrangement is shown in FIG. 6. In this arrangement, the light module 20, 21, 22 can be guided in the side area 31 in a sill-section 16 that extends into this side area 31. However, it is also possible for the light module 20, 21, 22 to be arranged in the side area 31 without use of a sill-section 16 in either the elevator car 12 or on the floor S1, S2. In the case of a sill-section 16 arranged at the side, the light module 21, 22 is cleaned by the car door 14, or hoistway door 13 respectively, being pushed into the door guide-grooves 17, 18 at the side.

The control of the light module 20, 21, 22 is not explained further here. It is performed by an elevator control that is not shown.

With the embodiment according to the invention, it is made possible to draw attention to a gap 30 between a floor S1, S2 and the elevator car 12. The light modules 20, 21, 22 are so arranged that they can be integrated into the sill-section 16 without great constructional outlay. The integration of the light module 20, 21, 22 into the sill-section 16 has the advantage that sliding of the car door 14, or hoistway door 13, past and over the respective light module 20, 21, 22 exerts a cleaning effect, so that the warning function of the light module 20, 21, 22 is not impaired by soiling.

The light modules can be directly integrated into a groove in the sill-section, the groove having smaller dimensions than the door guide-grooves. Space is thereby saved, and no additional mechanical element is needed for installation. In particular, no space is needed for the light module on the sill-section (see FIG. 2).

Figure 7:
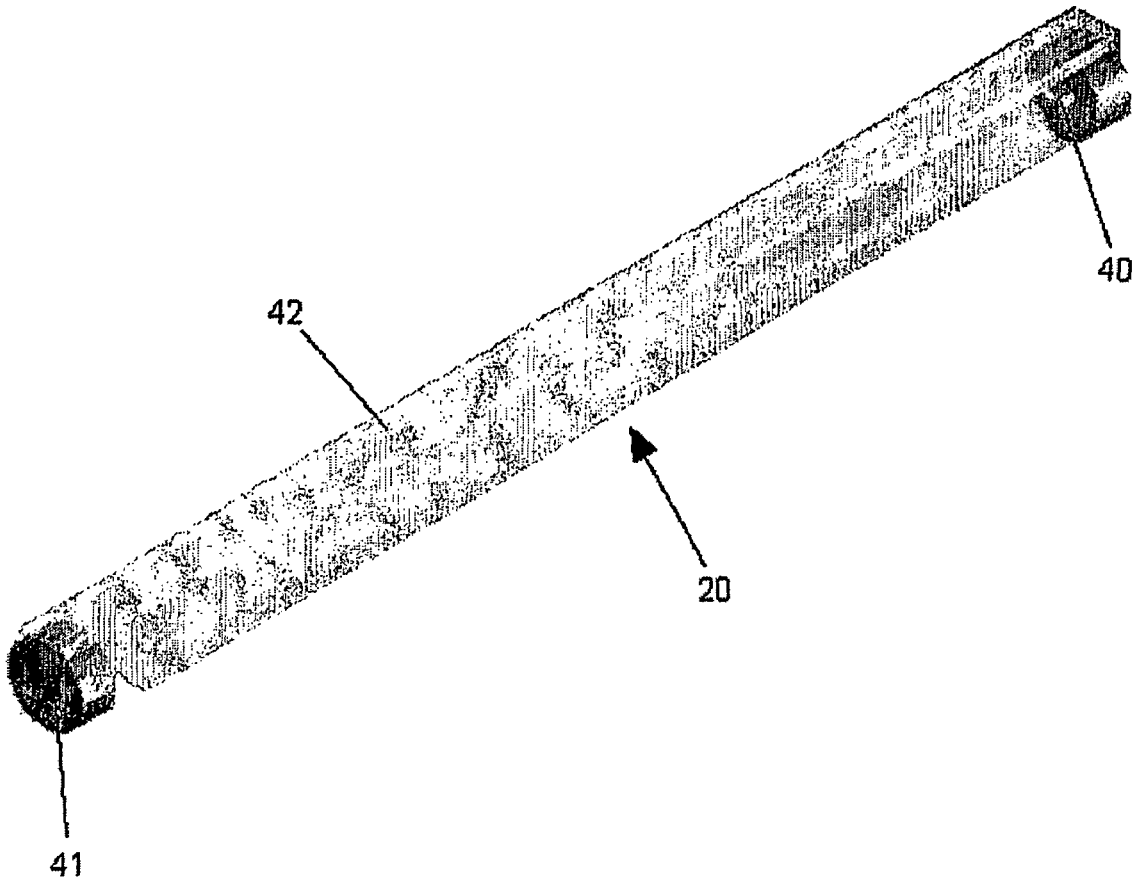
FIG. 7 a diagrammatic illustration of a light module according to the present invention.

FIG. 7 shows diagrammatically a light module 20 according to the present invention. Preferably fastened onto each of the outer ends of the light-module carrier is a cylindrical LED 40 that emits light into the inside of the channel. Through the tubular lens that lies in the channel of the light-module carrier, the light of the LEDs is distributed uniformly and projected outward. The lens and the LEDs are protected by a transparent cover 42. The holder 41 holds the LED and also performs a cooling function.

The invention claimed is:

1. An elevator installation, comprising:

an elevator car arranged movably in an elevator hoistway between floors, the elevator car having a car door;

a hoistway door on the floors;

a sill-section assigned to the car door or to the hoistway door and having an upper side with a door guide-groove; and at least one light module arranged space-savingly in the door guide-groove in the sill-section.

2. The elevator installation according to claim 1, wherein the sill-section has two door guide-grooves, the light module being arranged between the two door guide-grooves.

3. The elevator installation according to claim 1, having two light modules, including a first light module arranged in the door guide-groove so as to be directed in a direction of an interior of the elevator car, and a second light module arranged in the door guide-groove so as to be directed in an opposite direction to the first light module.

4. The elevator installation according to claim 1, wherein the light module radiates light in a white color range.

5. The elevator installation according claim 1, wherein the light module is operative to emit a light signal depending on a position of the car door or of the hoistway door.

6. The elevator installation according to claim 1, wherein the light module includes light emitting diodes (LEDs) that are arranged under a diffusing disk.

7. The elevator installation according to claim 6, wherein the diffusing disk is formed of a scratch-resistant material.

8. The elevator installation according claim 1, wherein the light module includes organic light-emitting substances which glow when supplied with current.

9. The elevator installation according to claim 1, wherein the light module includes an optical waveguide into which light can be coupled and which emits the light along an axial length of the waveguide in a direction of the elevator car or of the floor.

10. The elevator installation according claim 1, wherein the car door or hoistway door has a cleaning element arranged so that upon opening or closing of the car door or hoistway door the cleaning element moves over the light module so as to clean the light module.

11. The elevator installation according to claim 1, wherein the light module is friction-fit in the door guide-groove.

12. The elevator installation according to claim 1, wherein the light module is form-fit in the door guide-groove.

13. The elevator installation according to claim 1, wherein the light module is arranged in a vertical wall of the door guide-groove.

14. A method of indicating a gap between an elevator car and a floor in an elevator installation, the elevator car being movable in an elevator hoistway between floors, the method of comprising the steps of:

assigning a sill-section to a car door or a hoistway door; and arranging at least one light module that emits light in a visible range of wavelengths in a door guide-groove in an upper side of the sill-section.

* * * * *